US008979660B2

(12) United States Patent
Goldner et al.

(10) Patent No.: US 8,979,660 B2
(45) Date of Patent: Mar. 17, 2015

(54) HELICOPTER AMUSEMENT APPARATUS

(75) Inventors: Gal Goldner, Kibbutz Ginigar (IL); Iftah Geva, Kibbutz Reshafim (IL)

(73) Assignee: Aba Science Play Ltd., Reut (IL)

( * ) Notice: Subject to any disclaimer, the term of this patent is extended or adjusted under 35 U.S.C. 154(b) by 51 days.

(21) Appl. No.: 13/881,421

(22) PCT Filed: Oct. 9, 2011

(86) PCT No.: PCT/IL2011/000800

§ 371 (c)(1),
(2), (4) Date: Apr. 25, 2013

(87) PCT Pub. No.: WO2012/056444

PCT Pub. Date: May 3, 2012

(65) Prior Publication Data

US 2013/0225303 A1 Aug. 29, 2013

Related U.S. Application Data

(60) Provisional application No. 61/406,902, filed on Oct. 26, 2010.

(51) Int. Cl.

| | |
|---|---|
| ***A63G 1/12*** | (2006.01) |
| ***A63G 1/22*** | (2006.01) |
| ***A63G 1/30*** | (2006.01) |

(52) U.S. Cl.

CPC .. *A63G 1/12* (2013.01); *A63G 1/22* (2013.01); *A63G 1/30* (2013.01)

USPC ..... 472/1

(58) Field of Classification Search

CPC ..... A63G 1/12; A63G 1/22

USPC ..... 472/1, 14, 21

See application file for complete search history.

(56) References Cited

U.S. PATENT DOCUMENTS

| | | | | |
|---|---|---|---|---|
| 2,151,006 | A * | 3/1939 | West | 106/263 |
| 2,451,006 | A | 10/1948 | West | |
| 2,901,251 | A | 8/1959 | Pettit | |
| 3,449,843 | A | 6/1969 | Richter et al. | |
| 3,467,373 | A | 9/1969 | Justice | |
| 3,485,222 | A | 12/1969 | Biermann | |

(Continued)

FOREIGN PATENT DOCUMENTS

| | | | |
|---|---|---|---|
| CN | 201108737 | Y | 9/2008 |
| CN | 201168431 | Y | 12/2008 |

(Continued)

OTHER PUBLICATIONS

International Search Report of Application No. PCT/IL2011/000800 mailed on May 10, 2012.

WEB: Cybercide's Amazing Pedal-Powered Rides at the Maker Faire, http:/www.wired.com/gadgetlab/2007/05/cybercides_amaz/.

*Primary Examiner* — Michael Dennis

(74) *Attorney, Agent, or Firm* — Mark M. Friedman

(57) ABSTRACT

A helicopter amusement apparatus, which enables hovering, climbing and descending, and flying back and forth in a play helicopter by force of muscles with excellent steering performance. The helicopter amusement apparatus is equipped with a hydraulic system, which enables positioning a balancing weight in a suitable location to obtain equilibrium according to the weight of the using pilot to enable lifting and driving the cockpit by means of a small force generated by a rotor activated by the power source of the pilot's feet.

12 Claims, 11 Drawing Sheets

(56) References Cited

U.S. PATENT DOCUMENTS

| | | | | |
|---|---|---|---|---|
| 4,428,576 | A | 1/1984 | Fisher | |
| 4,435,133 | A | 3/1984 | Meulendyk | |
| 5,165,854 | A | 11/1992 | Cicare | |
| 8,342,975 | B1 * | 1/2013 | Bishop | 472/21 |
| 2003/0017880 | A1 * | 1/2003 | Kleimeyer | 472/118 |
| 2006/0283258 | A1 | 12/2006 | Chastain | |
| 2010/0219605 | A1 | 9/2010 | Hudgin | |

FOREIGN PATENT DOCUMENTS

| | | | |
|---|---|---|---|
| CN | 201227539 | Y | 4/2009 |
| JP | 9187572 | | 7/1997 |
| WO | WO 0030718 | | 6/2000 |
| WO | WO 01/76696 | | 10/2001 |
| WO | WO 2008059356 | | 5/2008 |

* cited by examiner

HELICOPTER AMUSEMENT APPARATUS

CROSS-REFERENCE TO RELATED APPLICATIONS

This application is a National Phase Application of PCT International Application No. PCT/IL2011/000800, International Filing Date Oct. 9, 2011, entitled "Helicopter Amusement Apparatus", published on May 3, 2012 as International Patent Application Publication Number WO 2012/056444 claiming priority of U.S. Provisional Patent Application No. 61/406,902, filed Oct. 26, 2010, each of which is incorporated herein by reference in its entirety.

FIELD OF THE INVENTION

The present invention relates to amusement apparatus, more particularly, to a helicopter amusement apparatus.

BACKGROUND OF THE INVENTION

Many playgrounds are equipped with a large variety of apparatus, such as swings, carousels, and slides. Playground designers have long been aware of the advantage to using apparatus that resemble vehicles in shape or other features. One such apparatus, which can provide much amusement, as well as help to develop motor skills of children playing with it, is a helicopter play apparatus.

For the development of skills, it can be advantageous to have such a helicopter play apparatus in which the user can effectively feel like a pilot, in control of hovering, ascending and descending, and even steering of the helicopter by means of one's arms and legs, while the lift force of the helicopter is, at least in part, achieved by rotation of the helicopter rotor, which is moved by force of the pilot's muscles.

In 1946, West William filed a patent application titled "Helicopter Roundabout".

A helicopter roundabout is described in U.S. Pat. No. 2,451,006 of West William, which is incorporated by reference for all purposes as if fully set forth herein.

FIG. 1 of the prior art illustrates the helicopter roundabout. The object of West William was to provide a roundabout having a toy helicopter mounted on one end of a support and having a driving motor mounted on the other end.

A later patent application was filed in 2001 by Choe Young-Min, titled "Helicopter-Like Exercising Device".

A helicopter-like exercising device is described in PCT application No. KR2001/000516, of Choe Young-Min, which is incorporated by reference for all purposes as if fully set forth herein.

FIG. 2 of the prior art illustrates the helicopter-like exercising apparatus.

The helicopter-like exercising apparatus comprises a rotating portion which is rotated by a control signal input from an outside. A lifting portion which is connected to an end of a rope is lifted by rotating force. The helicopter is lifted up and lowered down according to the motion of a rider, thereby providing interest, pleasure and exercise effect at the same time.

In spite of all the inventions proposed, playgrounds still lack an apparatus resembling a helicopter, which enables hovering, ascending and descending, and flying back and forth in a play helicopter by force of muscles with excellent steering performance.

None of the prior art apparatus comprises all of the above characteristics and functions.

SUMMARY OF THE INVENTION

The background art does not teach or suggest a helicopter amusement apparatus, which enables hovering, ascending and descending, and flying back and forth in a play helicopter by force of muscles with excellent steering performance.

The present invention overcomes these deficiencies of the background art by providing a helicopter amusement apparatus, which enables hovering, ascending and descending, and flying back and forth in a play helicopter by force of muscles with excellent steering performance, based on a balancing weight that is moved and disposed in a specific location on a lever arm, which provides balance to the cockpit, in which the pilot sits, according to one's individual weight, thus enabling a need for only small lift force relative to the weight of the pilot, a force that the pilot can generate by force of legs activating the helicopter rotor.

According to an embodiment of the present invention there is provided a helicopter amusement apparatus for a pilot, the helicopter amusement apparatus including: (a) a main pole, wherein the main pole positioned vertically, wherein at least part of the main pole has a horizontal rotational movement capability; (b) a main beam mechanically connected to the main pole, wherein the main beam has a limited vertical rotational movement capability; (c) a cockpit, wherein the cockpit is mechanically connected to the main beam (20), and wherein the cockpit is suspended below the main beam; (d) a rotor for producing lift and trust forces, mechanically connected to the cockpit; and (e) a balancing weight having limited linear movement capability along the main beam, wherein rotation of the rotor is by means of mechanical power produced by the legs of the pilot and transmitted to the rotor by a mechanical transmission system, and wherein linear movement of the balancing weight is generated by a hydraulic system, wherein the hydraulic system transmits power produced by a hand of the pilot.

According to further features in the described embodiment the helicopter amusement apparatus further includes: (f) a main beam shaft mechanically connected on the main beam enabling the vertical rotational movement of the main beam; (g) a cockpit carrying beam for carrying the cockpit the cockpit carrying beam is mechanically connected to the main beam by an axis; (h) a parallelogram beam for keeping the cockpit carrying beam vertically, the parallelogram beam being mechanically connected to the cockpit carrying beam by an axis; and (i) a main pole ring mechanically connected to the main pole the main pole ring having shaft carriers wherein the main beam shaft is mounted on the shaft carriers, and wherein the parallelogram beam is mechanically connected to the main pole ring by an axis.

According to still further features in the described embodiment the balancing weight has a balancing weight center of gravity, wherein the main beam shaft has a main beam shaft section center, and wherein when the main beam is in a horizontal position, the main beam shaft section center being higher than the balancing weight center of gravity by a balancing weight center of gravity height.

According to still further features in the described embodiment the balancing weight center of gravity height is at least one centimeter.

According to still further features in the described embodiment the helicopter amusement apparatus further includes: (j) a piston cylinder mechanically connected to the main beam; (k) a balancing weight piston having a front end a rear end located inside the piston cylinder; and (l) a piston connecting rod mechanically connected to the balancing weight piston and mechanically connected to the balancing weight.

According to still further features in the described embodiment the cockpit includes: (i) a cockpit floor; (ii) a pilot seat mechanically connected to the cockpit floor; (iii) a steering stick mechanically connected to the floor by an axis wherein the steering stick has a rotational movement capability with relation to the floor; (iv) a climbing handle mechanically connected to the floor, wherein the climbing handle has a rotational movement capability with relation to the floor; (v) a pedal shaft mechanically connected to the floor wherein the pedal shaft has a rotational movement capability with relation to the floor; (v) a pedal mechanically connected to the pedal shaft; and (vi) an immobilizer handle mechanically connected to the steering stick by an axis.

According to still further features in the described embodiment the helicopter amusement apparatus further includes: (m) a pitch bars assembly mechanically connected to and between the cockpit carrying beam and the cockpit in such a way that changing a steering stick angle of the steering stick causes a change of a pitch angle of the cockpit.

According to still further features in the described embodiment the pitch bars assembly includes: (i) a first bar mechanically connected to and between the cockpit carrying beam and the cockpit having a rotational movement capability in relation to the cockpit carrying beam; (ii) a second bar mechanically connected to the first bar; (iii) a third bar mechanically connected to the second bar having a rotational movement capability in relation to the second bar; and (iv) a fourth bar mechanically connected to and between the third bar and the steering stick having a rotational movement capability in relation to the third bar and the steering stick.

According to still further features in the described embodiment the cockpit further includes: (vii) a dynamo mechanically connected to the cockpit floor in such a way that a rotating of the pedal causes the dynamo to generate and provide electrical power.

According to still further features in the described embodiment the mechanical transmission system includes: (i) a first cog wheel mechanically connected to the pedal shaft; (ii) a second cog wheel; (iii) a first chain wound on the first cog wheel and on the second cog wheel; (iv) a third cog wheel mechanically connected to the second cog wheel; (v) a fourth cog wheel; (vi) a second chain wound on the third cog wheel and on the fourth cog wheel; (v) a gear box mechanically connected to the cockpit and to the fourth cog wheel; and (vi) a rotor pole mechanically connected to the gear box.

According to still further features in the described embodiment the rotor is mechanically connected to the rotor pole and wherein the rotor includes: (i) at least two rotor wings wherein each one of the rotor wings has a wing aerodynamic profile.

According to still further features in the described embodiment the hydraulic system includes: (i) an accumulator pneumatically connected to the balancing piston cylinder; (iii) an oil tank hydraulically connected to the balancing piston cylinder; and (iv) an oil pump hydraulically connected to and between the balancing piston cylinder and the oil tank and mechanically connected to the climbing handle.

According to still further features in the described embodiment the hydraulic system further includes: (v) an immobilizer hydraulically connected to and between the oil pump and the balancing piston cylinder and hydraulically connected to the oil tank and mechanically connected to the immobilizer handle; and (vi) a height limiter valve hydraulically connected to and between the immobilizer and balancing piston cylinder.

According to an embodiment of the present invention there is provided a method for operation of a hydraulic system of a helicopter amusement apparatus the method including the stages of: (a) checking if a immobilizer handle of the amusement apparatus is pressed; (b) if the immobilizer handle is not pressed, returning a balancing weight of the amusement apparatus to an initial state; (c) if the immobilizer handle is not pressed, returning a cockpit of the amusement apparatus to an initial state; (d) checking if the cockpit is above a limiter height; (e) if the cockpit is above the limiter height, disabling an oil pump; (f) if the cockpit (30) is above the limiter height, enabling a production of lift force; (g) if the cockpit is not above the limiter height, operating the oil; and (h) if the cockpit is not above the limiter height moving the balancing weight outward.

According to an embodiment of the present invention there is provided a method for activation of a helicopter amusement apparatus, the method including the stages of: (a) taking a seat in pilot seat of the helicopter amusement apparatus by a user and placing the user's feet upon pedals of the helicopter amusement apparatus; (b) pressing on an immobilizer handle of the helicopter amusement apparatus and performing pumping motions with a climbing handle of the helicopter amusement apparatus by the user, wherein the pumping motions activates an oil pump of the helicopter amusement apparatus forming hydraulic pressure and causing oil of the helicopter amusement apparatus to flow to a rear side of a balancing weight piston of the helicopter amusement apparatus; (c) pushing a balancing weight of the helicopter amusement apparatus until a cockpit of the helicopter amusement apparatus starts to ascend wherein beginning of the ascent depends upon an exact location of the balancing weight, which depends on a weight of the user; (d) if the cockpit is above a certain given height, pressing a height limiter valve, and preventing any increase of hydraulic pressure; (e) rotating the pedals with the user legs causing a rotor of the helicopter amusement apparatus to turn and to generate lift force causing the cockpit to ascend higher; (f) tilting forward, by the user, a steering stick of the helicopter amusement apparatus causing the rotor to tilt forward and to provide a thrust force causing the cockpit to move by a rotational movement around a main pole of the helicopter amusement apparatus; and (g) relieving the pressing from the immobilizer handle causing the hydraulic pressure to cease acting upon the balancing weight piston, and a pneumatic pressure from an accumulator acting on the balancing weight piston and returning the balancing weight to an initial state.

Additional objects and advantages of the invention will be set forth in part in the description which follows and, in part, will be obvious from the description, or may be learned by practice of the invention.

BRIEF DESCRIPTION OF THE DRAWINGS

The invention is herein described, by way of example only, with reference to the accompanying drawings, wherein.

Figure 1:
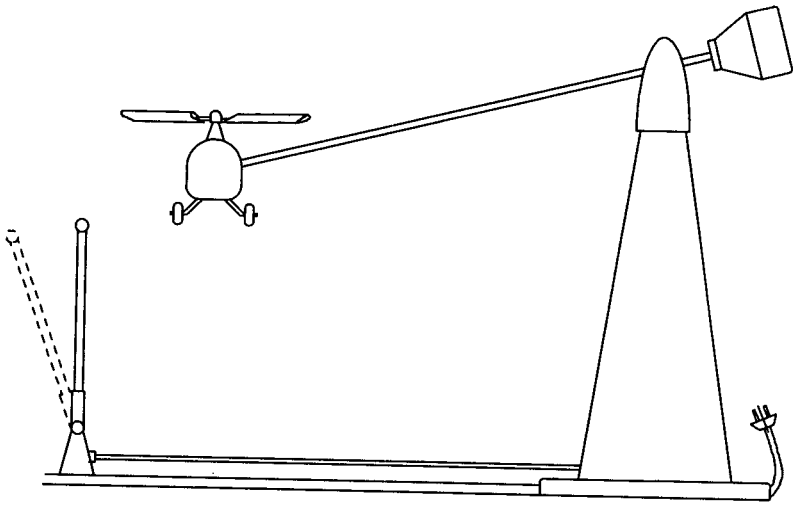
FIG.1 PRIOR ART
FIG. 1 is a side view schematic illustration a prior art helicopter roundabout.
Figure 2:
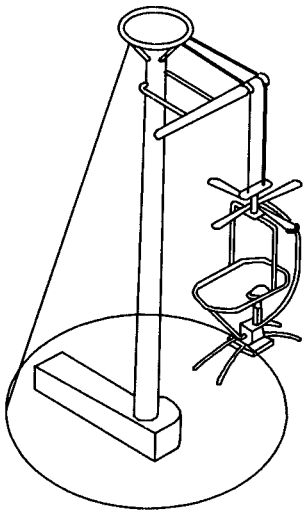
FIG. 2 PRIOR ART
FIG. 2 is an isometric view illustration of prior art helicopter-like exercising apparatus.

In order to remove any doubt, the elements shown in the illustrations of the present patent application in a manner that enables understanding them clearly, and the scales, size relations, and shapes are not in any way limiting them. Likewise, it is noted that reference numerals may be repeated among the figures to indicate corresponding or analogous elements.

DETAILED DESCRIPTION OF EMBODIMENTS OF THE INVENTION

To remove any doubt, note that the manner in which the elements of the present invention are described in the illustrations can be highly detailed, however is not in any way limiting the present illustration, however is for the purpose of clarification and furthering understanding. The present invention can be implemented in embodiments that differ from the specification given with regard to the illustration.

The present invention is of a helicopter amusement apparatus. The principles and operation of a helicopter amusement apparatus according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

The following list is a legend of the numbering of the application illustrations:

1 helicopter amusement apparatus
2 pilot
2*h* hand
2*l* leg
10 main pole
12 main pole ring
13 shaft carrier
15 axis
20 main beam
21 parallelogram beam
22 cockpit carrying beam
23 vertical angular movement
24 horizontal angular movement
25 main beam shaft
25*a* main beam shaft section center
27 confinement device
30 cockpit
31 pilot seat
32 steering stick
32*a* steering stick angle
32*b* pitch angle
33 pedal
33*a* pedal shaft
35 immobilizer handle
34 climbing handle
36 dynamo
37 pitch bars assembly
37*a* first bar
37*b* second bar
37*c* third bar
37*d* fourth bar
38 cockpit floor
39 tail
40 mechanical transmission system
40 rotor pole
42*a* first chain
42*b* second chain
43*a* first cog wheel
43*b* second cog wheel
43*c* third cog wheel
43*d* fourth cog wheel
44 gear box
50 rotor
51 rotor wing
52 wing aerodynamic profile
53 wing angle of attack
70 hydraulic systems
71 oil tank
72 oil
73 oil pump
75 oil pipe
76 immobilizer
77 balancing weight piston
77*a* piston connecting rod
77*b* piston cylinder
77*f* front end (of the balancing weight piston)
77*r* rear end (of the balancing weight piston)
78 height limiter valve
79 accumulator

80 balancing weight
81 balancing weight center of gravity
82 linear movement
100 swing center of gravity
H. L. horizon line
L lift force
T thrust force
$d_1$ initial distance
$d_2$ equilibrium distance
$h_1$ balancing weight center of gravity height
$h_2$ minimal cockpit height
$h_3$ cockpit limiter height
teta alignment angle Hereinafter, embodiments of the present invention are explained in detail by referring to the drawings.

Figure 3:
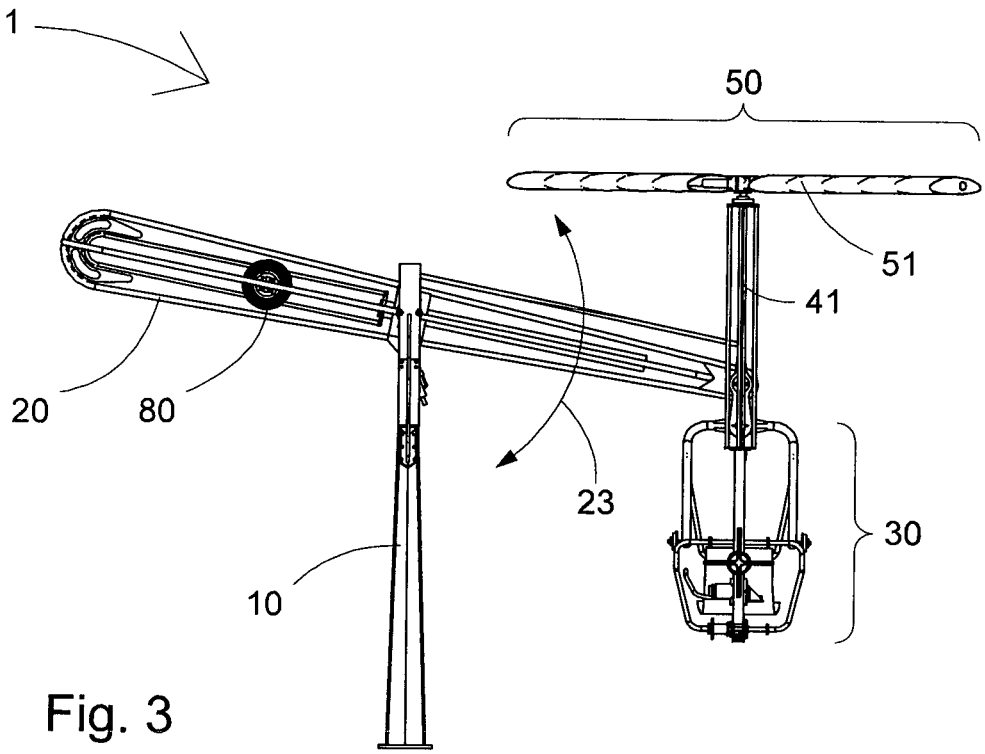
FIG. 3 is a front view, schematic illustration of an embodiment of a helicopter amusement apparatus, according to the present invention.

FIG. 3 is a front view, schematic illustration of an embodiment of a helicopter amusement apparatus 1, according to the present invention.

The helicopter amusement apparatus 1 includes five main assemblies, a main pole 10, a main beam 20, a cockpit 30, a rotor 50, rotor pole 41 and a balancing weight 80.

The main pole 10 is perpendicular to the horizon and bears the axial and radial loads of the apparatus.

The main beam 20 is connected to the main pole 10 with limited movement ability, as a lever, similarly to a see-saw with vertical angular movement 23.

Under one of its ends, the cockpit 30 is suspended and is connected to the rotor 50 by means of the rotor pole 41.

The balancing weight 80 is mounted upon the main beam 20 and has limited linear movement 82 (market on FIG. 10), ability along the length of the main beam 20.

At an initial state, upon starting use of the helicopter amusement apparatus 1 the rotor pole 41 is also perpendicular to the horizon.

Figure 4:
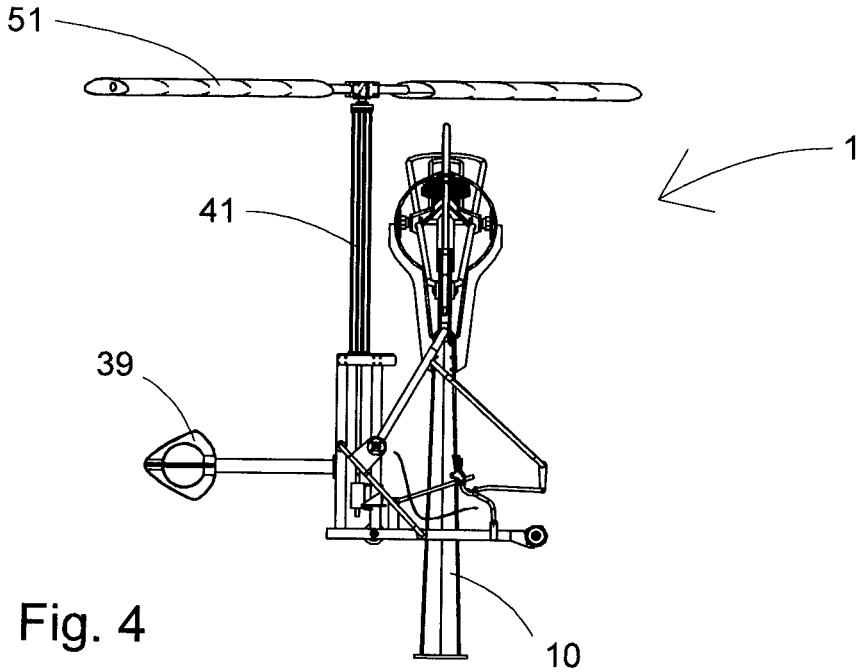
FIG. 4 is a right side view, schematic illustration of an embodiment of a helicopter amusement apparatus, according to the present invention.

FIG. 4 is a right side view, schematic illustration of an embodiment of a helicopter amusement apparatus 1, according to the present invention.

In order to maximize the enjoyment and attraction of the helicopter amusement apparatus 1, it can be aesthetically designed so as to please the eye; for example, with the addition of a tail 39 thus the main beam 20 can be shaped conically and constructed with several bars and other parts.

Figure 5:
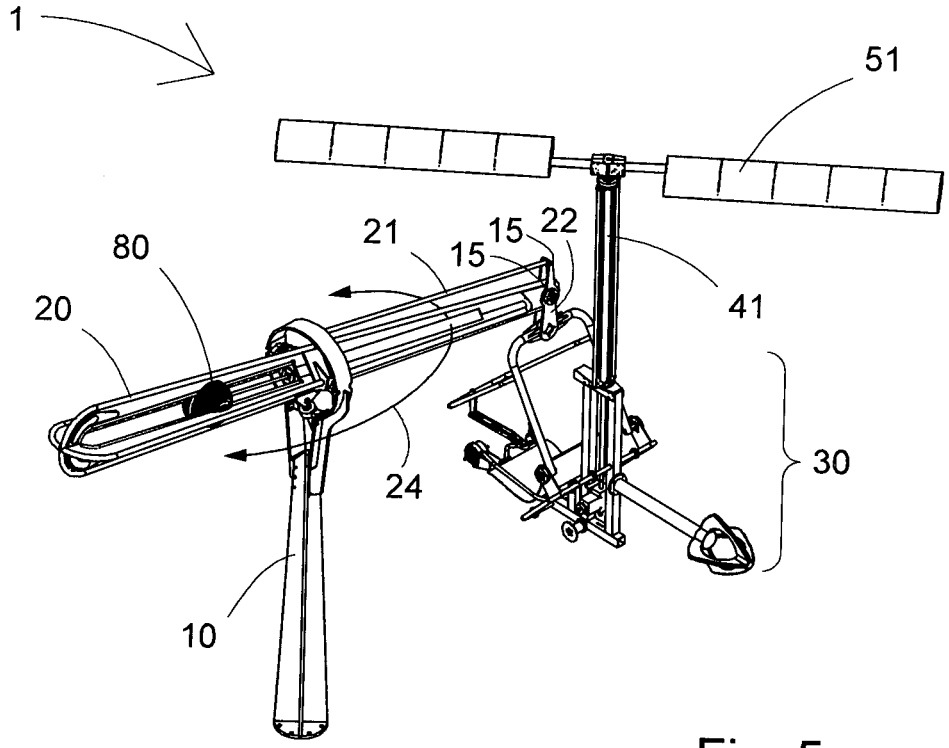
FIG. 5 is a left side isometric view, schematic illustration of an embodiment of a helicopter amusement apparatus, according to the present invention.

FIG. 5 is a left side isometric view, schematic illustration of an embodiment of a helicopter amusement apparatus 1, according to the present invention.

The main beam 20 has a horizontal angular movement 24, which can be made with part of or the entire main pole 10.

Figure 6:
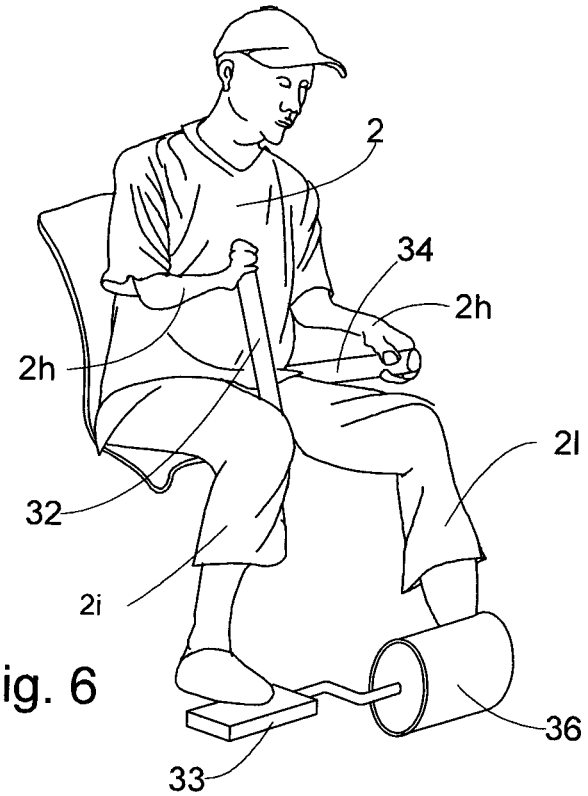
FIG. 6 is an isometric view schematic illustration of a pilot holding a climbing handle and steering stick by hand, with legs on a pedal, according to the present invention.

FIG. 6 is an isometric view schematic illustration of a pilot 2 holding a climbing handle 34 and steering stick 32 by hand, with legs on a pedal 33, according to the present invention.

Figure 7:
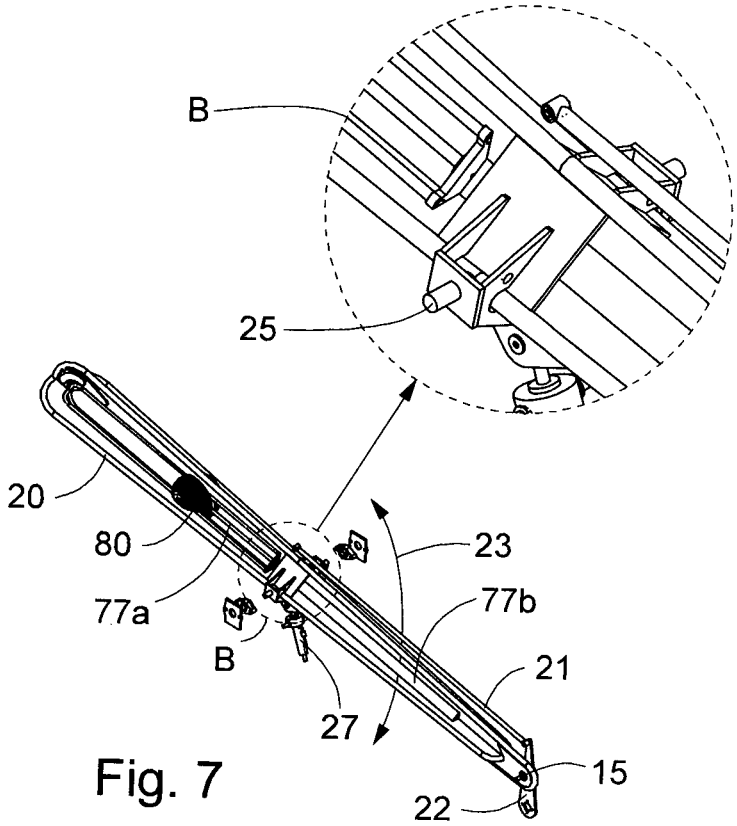
FIG. 7 is a right side isometric view, schematic illustration of a main beam, a balancing weight within, as well as additional components, according to the present invention.

FIG. 7 is a right side isometric view, schematic illustration of a main beam 20, a balancing weight 80 within, as well as additional components, according to the present invention.

The illustration marks detail B in a circle, which is magnified in the circle on the upper side of the illustration, which also shows the main beam shaft 25, which serves for connection enabling angular movement such as that of a see-saw, on the vertical plane.

A cockpit carrying beam 22 stays perpendicular to the horizon and thus also parallel to the main pole, at all times by means of a parallelogram beam 21.

The cockpit carrying beam 22 and the main beam 20 are both connected by means of a common axis 15.

Note: The helicopter amusement apparatus (1) includes several axes all of which are marked in the illustrations as 15, however this is in no way to establish that all axes are identical, and the axes can be of different sizes and other different features.

The cockpit carrying beam 22 can be made of a single beam, or two or more beams, and it bears the cockpit 30 (not shown in the present illustration, shown in FIGS. 3, 4 and more), suspended underneath.

For the purpose of confining the vertical angular movement 23, it is connected to a confinement device 27, which can also be a brake piston. Likewise, the present illustration also shows a balancing piston cylinder 77*b*, mechanically connected to main beam 20, which serves as a support point. The location of connection between them can be chosen according to the convenience of production, assembly, and operation. Its piston connecting rod 77*a* is mechanically connected to balancing weight 80 for the purpose of moving it in linear movement of a limited length along the main beam 20.

Figure 8:
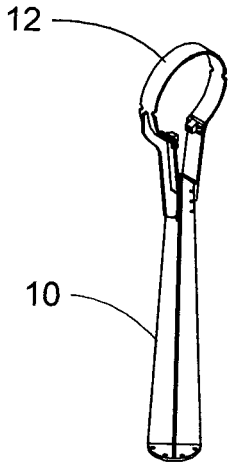
FIG. 8 is a right side isometric view, schematic illustration of a main pole, according to the present invention.

FIG. 8 is a right side isometric view, schematic illustration of a main pole 10, according to the present invention.

The top end of the main pole 10 is connected to a main pole ring 12, which is meant to carry the main beam 20, and which is also connected to the parallelogram beam 21 (both not shown in the present illustration, shown in FIG. 7).

The shape of the main pole ring 12 is shown here as a mostly circular ring, however other shapes are possible, such as elliptical, rectangular, etc.

Figure 9:
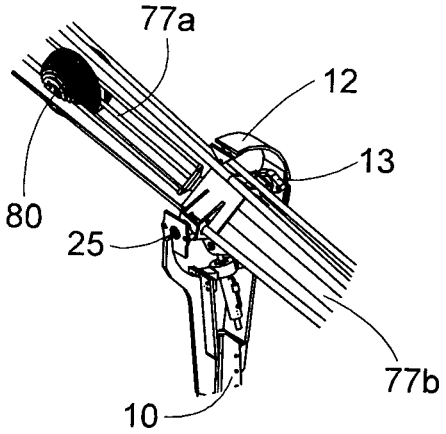
FIG. 9 is a right side isometric view, schematic illustration of a segment of the main beam, and a segment of the main pole, according to the present invention.

FIG. 9 is a right side isometric view, schematic illustration of segment of the main beam 20, and a segment of the main pole 10, according to the present invention.

The illustration shows the area of connection of the main beam 20 to the main pole 10. A segment of the main pole ring 12 is missing from the present illustration for the purpose of showing details in the connection area.

The main pole ring 12 includes a shaft carrier 13, which is connected to the main beam 20 by means of the main beam shaft 25.

Figure 10:
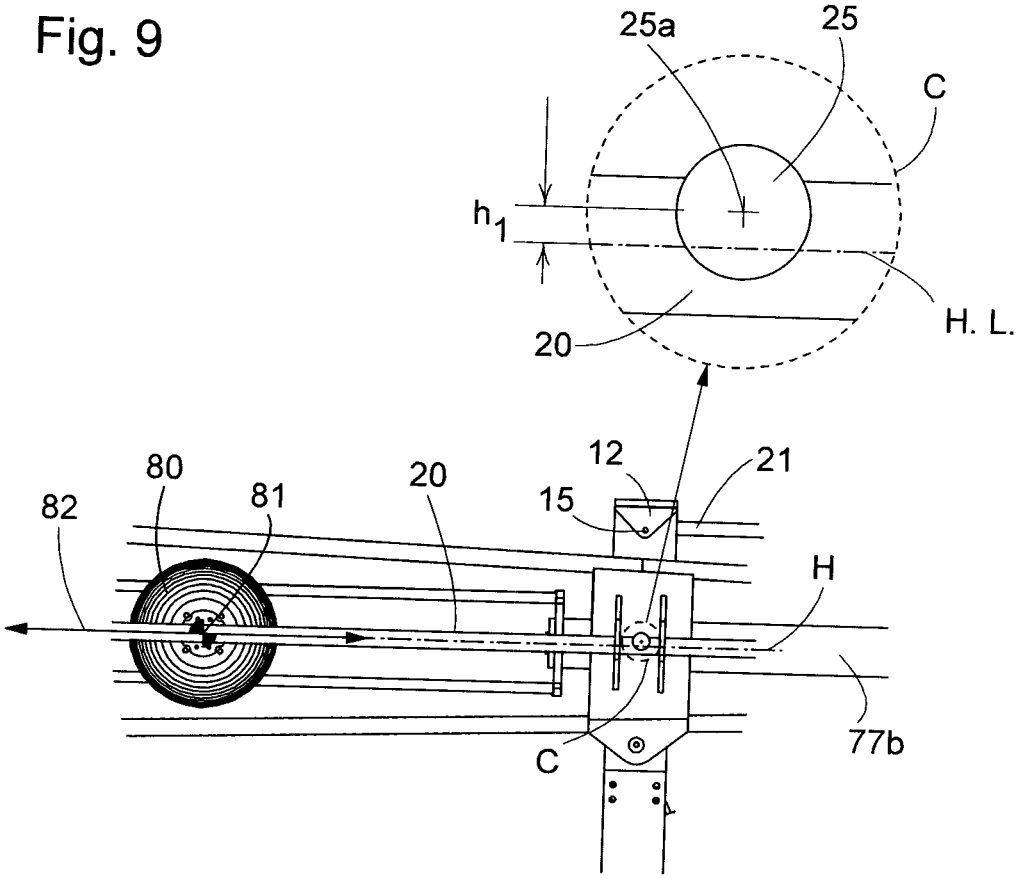
FIG. 10 is a front view, schematic illustration of segment of the main beam, and a segment of the main pole, and the balancing weight, according to the present invention.

FIG. 10 is a front view, schematic illustration of segment of the main beam 20, and a segment of the main pole 10, and the balancing weight 80, according to the present invention.

The illustration shows the area of connection between the main beam 20, to the main pole 10.

The illustration also shows a horizon line H. L., at a height of the balancing weight center of gravity 81 when the main beam 20 is disposed horizontally.

The illustration marks detail C in a circle, which is magnified in the circle on the upper side of the illustration. The present illustration shows the main beam 20 in a horizontal position. The illustration shows the balancing weight center of gravity height $h_1$, which is the vertical gap between the balancing weight center of gravity 81*a* and the main beam shaft section center 25*a*, and is greatly significant in the present invention with regarding to states of equilibrium, as will be specified below. This gap can be rather small relative to the dimensions of the helicopter amusement apparatus 1, even one centimeter can suffice. The illustration shows the point of connection of the parallelogram beam 21 to the main pole ring 12 by an axis 15.

The balancing weight 80 has limited linear movement 82 ability along the length of the main beam 20.

Figure 11A:
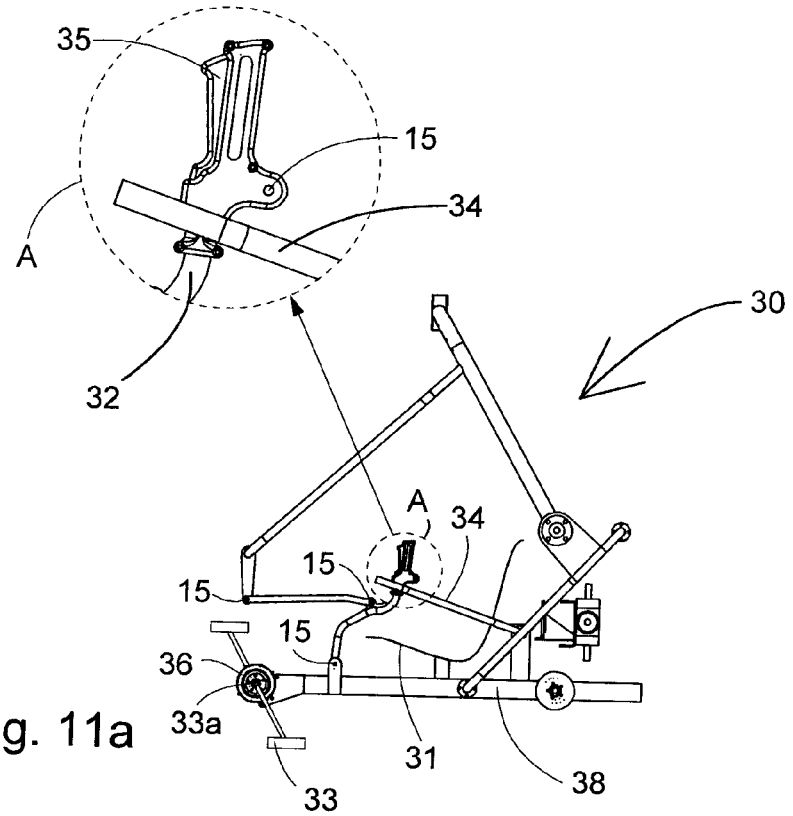
FIG. 11*a* is a left side view, schematic illustration of a cockpit, according to the present invention.

FIG. 11*a* is a left side view, schematic illustration of a cockpit 30, according to the present invention.

The illustration marks detail A in a circle, which is magnified in the circle on the upper left side of the illustration.

Cockpit 30 also includes a pilot seat 31 mechanically connected to cockpit floor 38 and a steering stick 32, at the head of which is a immobilizer handle 35, mechanically connected to said steering stick 32 by an axis 15.

The cockpit floor 38 is connected to a dynamo 36, which is driven by a pedal shaft 33*a*, which receives drive power from both pedals 33, by rotating them.

Dynamo 36 generates and provides electrical power to electric components, if there are any such in the helicopter amusement apparatus 1, such as light bulbs, or LEDs, which can be installed at the tips of the rotor wings 51, (not shown in the present illustration, shown in FIGS. 3, 4 and more).

If there is no need for electricity, dynamo 36 can be replaced with a bearing. Likewise, cockpit 30 also includes a climbing handle 34.

As shown in the present illustration, there is use of axis 15 between some of the components which have rotational movement.

Figure 11B:
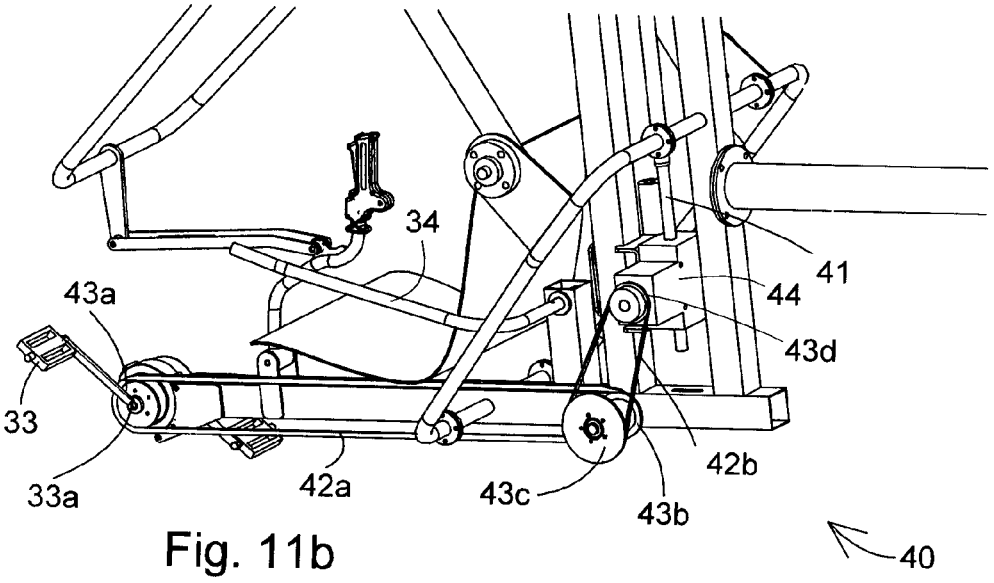
FIG. 11*b* is a left side isometric view, schematic illustration of a mechanical transmission system, according to the present invention.

FIG. 11*b* is a left side isometric view, schematic illustration of a mechanical transmission system 40, according to the present invention.

The mechanical transmission system 40 transmits rotational movement from the pedal shaft 33*a* to the rotor pole 41.

The mechanical transmission system 40 shown in the present illustration is one of several possible options for transmitting rotational movement and is in no way limiting the present invention. It includes a first cog wheel 43*a*, which is connected to the pedal shaft 33*a*, which is wound with a first chain 42*a*, which is also wound on a second cog wheel 43*b*. The second cog wheel 43*b* is connected by means of a common shaft to a third cog wheel 43*c*, which is wound with a second chain 42*b*, which is also wound on a fourth cog wheel 43*d*. The fourth cog wheel 43*d* has a common shaft with a gear box 44. Gear box 44 transmits rotational movement to the rotor pole 41.

Figure 12:
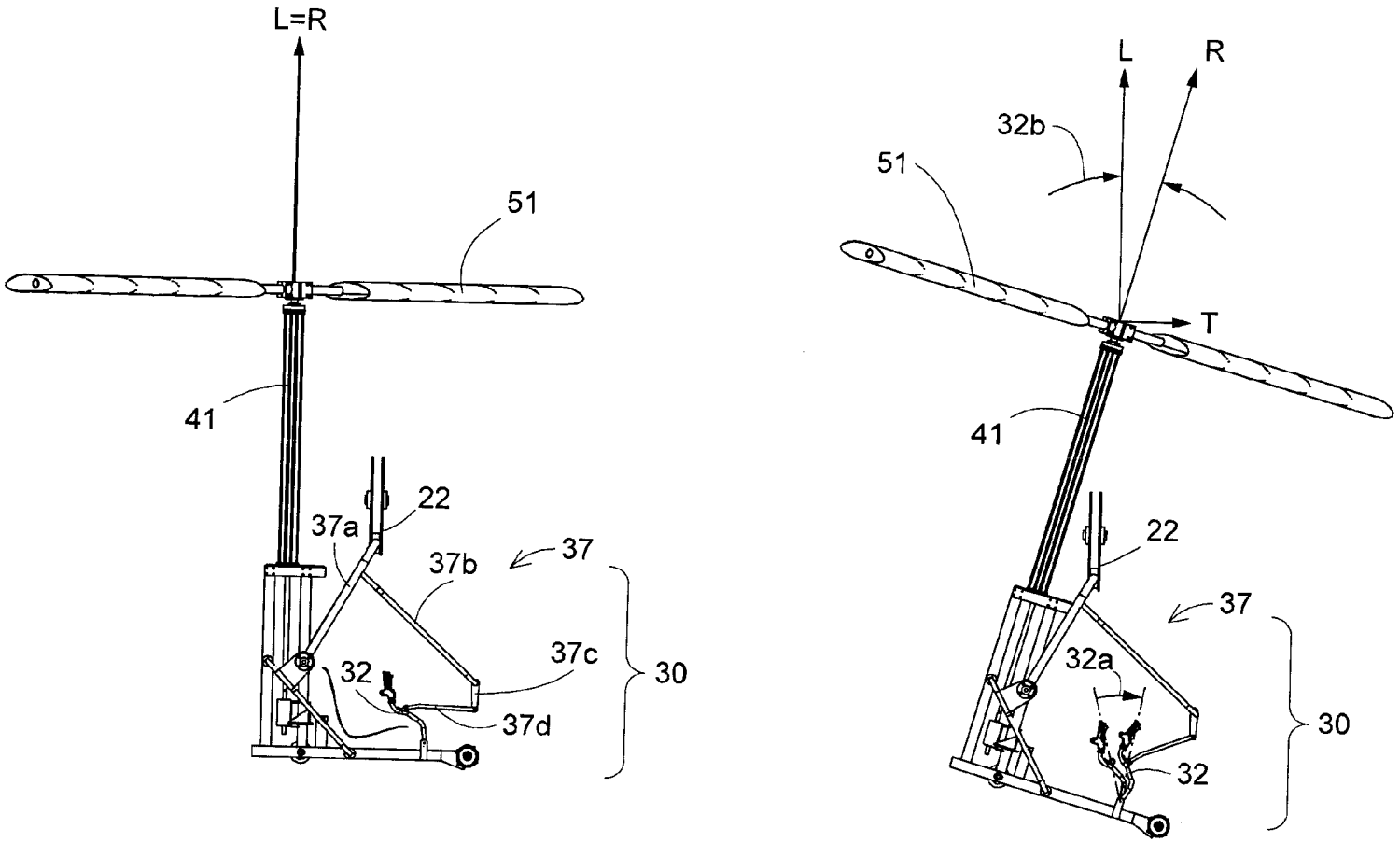
FIG. 12 is a left side view, schematic illustration of a cockpit, in two pitch states, according to the present invention.

FIG. 12 is a left side view, schematic illustration of a cockpit 30, in two pitch states, according to the present invention.

In the pitch states shown on the left side of the illustration, the rotor pole 40 is vertical and all of the force generated by the rotor wings 51 is lift force L.

The pitch state shown on the right side of the illustration is achieved by moving the steering stick 32 forward by steering stick angle 32*a*.

Every change of the steering stick angle 32*a* results in a change of the pitch angle 32*b*.

By means of the pitch bars assembly 37 the cockpit 30 is tilted, along with the rotor pole 40. In this state, the force generated by the rotor wings 51 includes two components, a lift force L and a thrust force T.

The pitch bars assembly 37 can include, for example, a first bar 37*a* having rotational movement ability on the vertical plane, on an axis relative to cockpit 30, a second bar 37*b* rigidly connected to the first bar 37*a*, a third bar 37*c*, and a fourth bar 37*d*, all of which are connected as shown in the illustration, by means of shafts, with the fourth bar 37*d* being connected by means of a shaft to the steering stick 32.

Figure 13A:
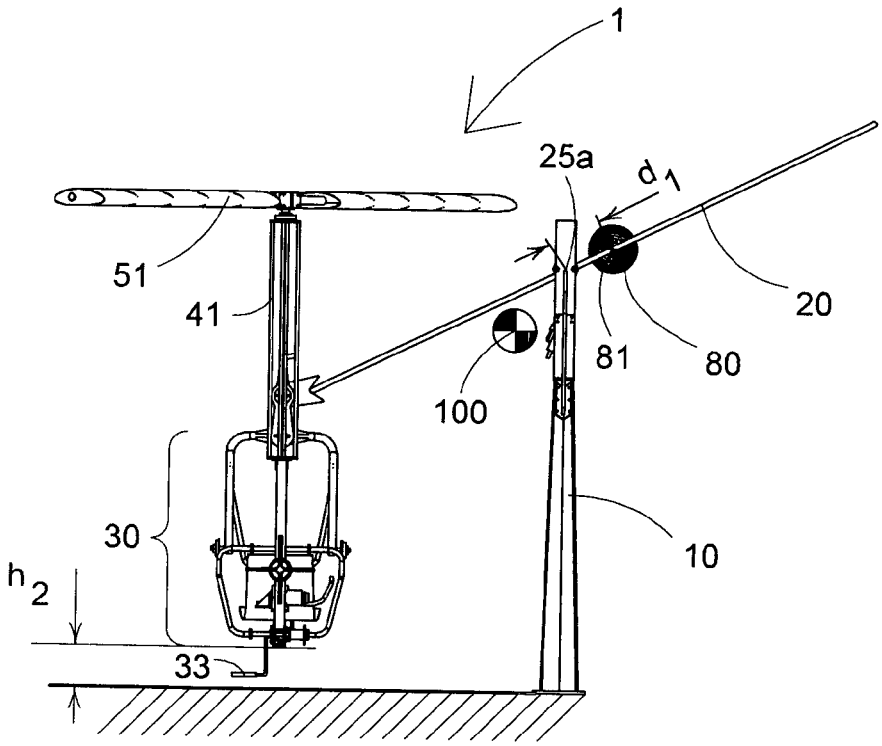
FIG. 13*a* is a rear view, in stable state, schematic illustration of an embodiment of a helicopter amusement apparatus, according to the present invention.

FIG. 13*a* is a rear view, in stable state, schematic illustration of an embodiment of a helicopter amusement apparatus 1, according to the present invention.

In this initial state, the cockpit 30 is at minimal cockpit height $h_2$ above the ground, this height being sufficiently low as to enable convenient access of the cockpit 30, while being sufficiently high as to enable activation of the pedal 33.

The balancing weight 80 is disposed along the main beam 20 with an initial distance $d_1$ between the main beam shaft section centre 25*a* to the balancing weight center of gravity 81 so that the swing center of gravity 100 is between the main pole 10 and the rotor pole 40. This state is stable to the extent that addition of weight in the area of the cockpit 30 will not cause its descent, while causing its ascent would require a significant lift force, of the order of magnitude of the pilot's weight.

The swing center of gravity 100 is the center of gravity of the main beam 20 for the sum of its parts and any load it is bearing, namely it is the center of gravity of the helicopter amusement apparatus 1, not including the weight of the main pole 10.

Figure 13B:
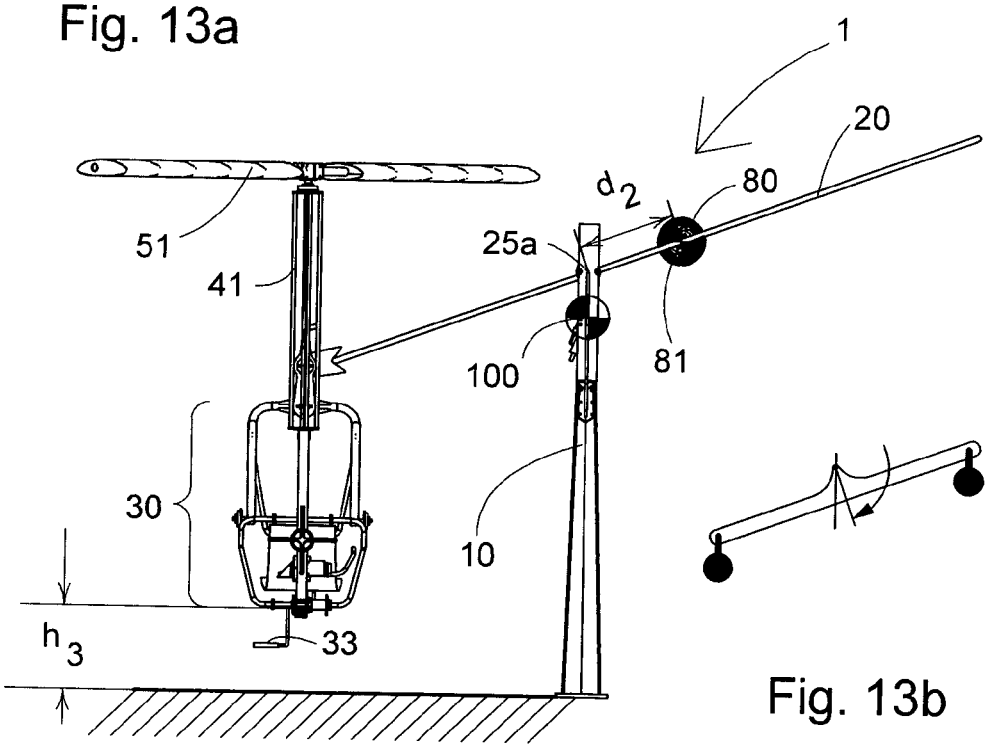
FIG. 13*b* is a rear view, in equilibrium state, schematic illustration of an embodiment of a helicopter amusement apparatus, according to the present invention.

FIG. 13*b* is a rear view, in equilibrium state, schematic illustration of an embodiment of a helicopter amusement apparatus 1, according to the present invention.

In this state the balancing weight 80 is at a distance from the main beam shaft section center 25*a* along the length of the main beam 20 as far as equilibrium distance $d_2$ between the main beam shaft section center 25*a* to the balancing weight center of gravity 81, so that the swing center of gravity 100 is upon the main pole 10. This is a state of equilibrium, which resembles that of a see-saw as illustrated on the right side of the illustration. Any vibration on either side moves the balancing weight center of gravity 81 from the vertical line under the point of suspension on the main beam shaft section centre 25*a*, and the force of gravity, which acts on it drives to return it to its original state. The value of the equilibrium distance $d_2$ depends on the weight of the pilot and varies for pilots of different weights. Ascent of the cockpit 30 is achieved by means of a hydraulic system 70, (not shown in the present illustration, shown in FIG. 14).

The hydraulic system 70 cannot lift the cockpit 30 any higher than a specific given height.

Figure 13C:
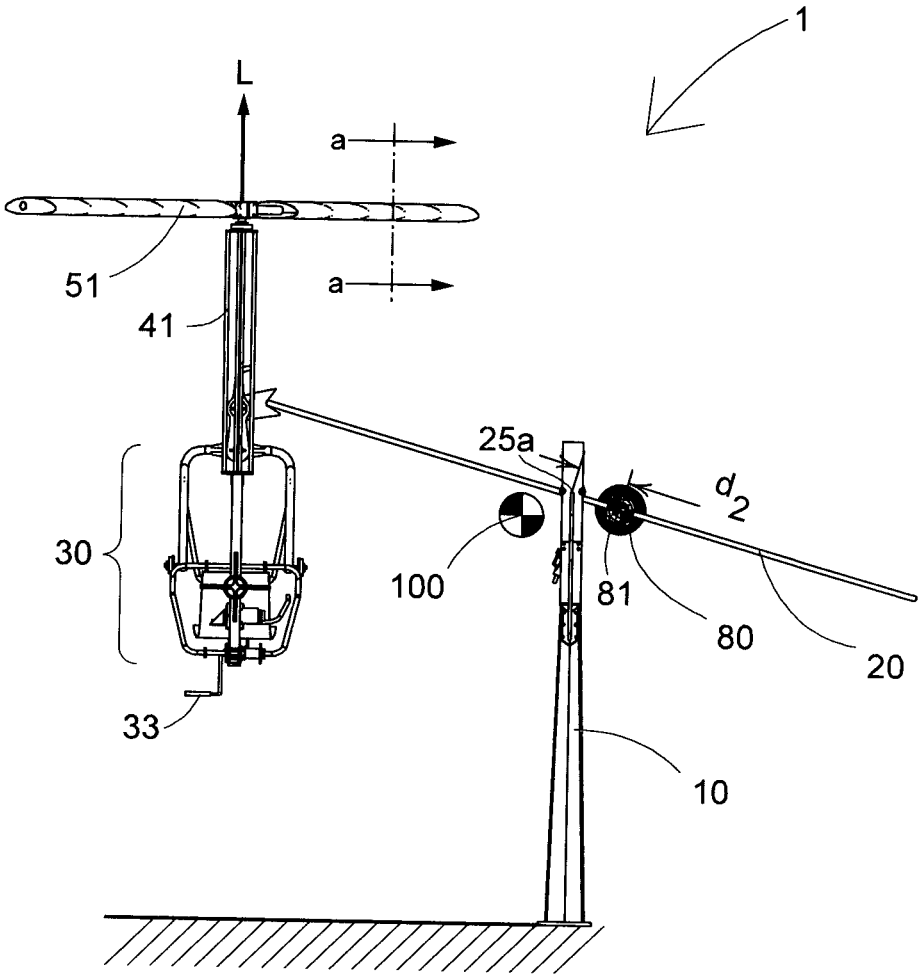
FIG. 13*c* is a rear view, in non-stable state, schematic illustration of an embodiment of a helicopter amusement apparatus, according to the present invention, upon which a section plane a-a is marked.

FIG. 13*c* is a rear view, in non-stable state, schematic illustration of an embodiment of a helicopter amusement apparatus 1, according to the present invention, upon which a section plane a-a is marked.

When the rotor wings 51 create lift force L, the main beam 20 ascends on the side from which the cockpit 30 is suspended, thus causing the swing center of gravity 100 to move slightly toward the area between the main beam shaft section center 25*a* to the balancing weight center of gravity 81. The size of this movement depends on the power of lift force L. If the lift force L ceases, the stable state of equilibrium will be regained. The power of the lift force L necessary to shift from the state of equilibrium and lift the cockpit 30 upwards is now relatively small, and a force equal, for the purpose of demonstration, to 2 kilograms, for example, would suffice.

Figure 13D:
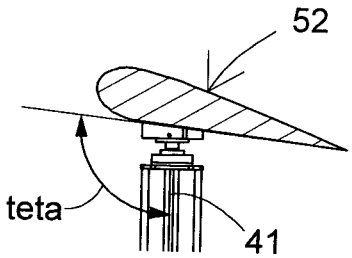
FIG. 13*d* is cross sectional view a-a illustration of a rotor wing according to some embodiment of the present invention.

FIG. 13*d* is cross sectional view a-a illustration of a rotor wing 51, according to some embodiment of the present invention. The section of rotor wing 51 has a wing aerodynamic profile 52 and is disposed at angle of attack alfa relative to the direction of air flow on it when it is rotating.

The shape of the wing aerodynamic profile 52 can be chosen from a variety of shapes known to aeronautic engineers and can be fixed or can change along the length of the rotor wing 51, and likewise with regard to the alignment angle teta relative to rotor pole 41, all for the purpose of high aerodynamic efficiency from the rotor wing 51.

Figure 14:
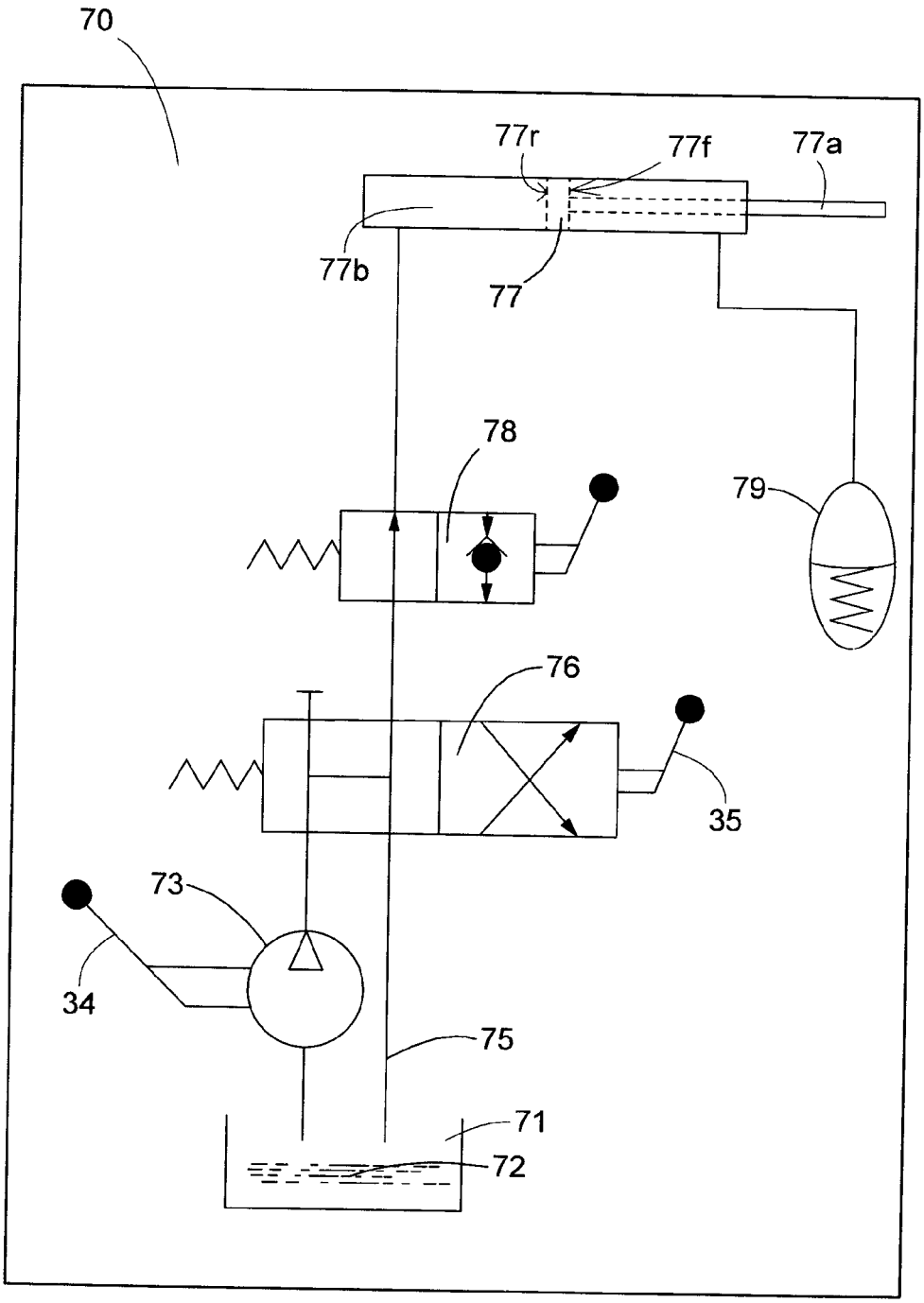
FIG. 14 is block diagram schematically illustrating a hydraulic systems of the helicopter amusement apparatus, according to some embodiments of the invention.

FIG. 14 is a block diagram schematically illustrating a hydraulic system 70 of the helicopter amusement apparatus 1, according to some embodiments of the invention.

The hydraulic system 70 controls the state of the balancing weight piston 77.

The balancing weight piston 77 is within a piston cylinder 77*b* and can move along its length with the movement being dependent on the pressures being applied to it from both sides.

The balancing weight piston 77 receives, on its front end 77*f* pneumatic pressure originating from an accumulator 79, and on its rear end 77*r* hydraulic pressure. Initially, the hydraulic pressure in the system is zero, or lower than the pneumatic pressure and therefore the balancing weight piston 77 is at an initial state for the entire movement to the left shown in the present illustration, which corresponds with the state shown in FIG. 13*a*.

When pumping is performed by means of the climbing handle 34, the oil pump 73 pumps oil 72 from the oil tank 71. The oil 72 flows under pressure through the oil pipe 75, through immobilizer 76, if the immobilizer handle 35 is pressed.

When the cockpit 30 (not shown in the present illustration, shown in FIGS. 13*a*-13*c*, and more) reaches, or any height higher than that, cockpit limiter height $h_3$, (not shown in the present illustration, shown in FIG. 13*b*) a height limiter valve 78 prevents any increase in hydraulic pressure. The cockpit limiter height $h_3$ is at a height very slightly above minimal cockpit height $h_2$, (not shown in the present illustration, shown in FIG. 13*a*).

Figure 15:
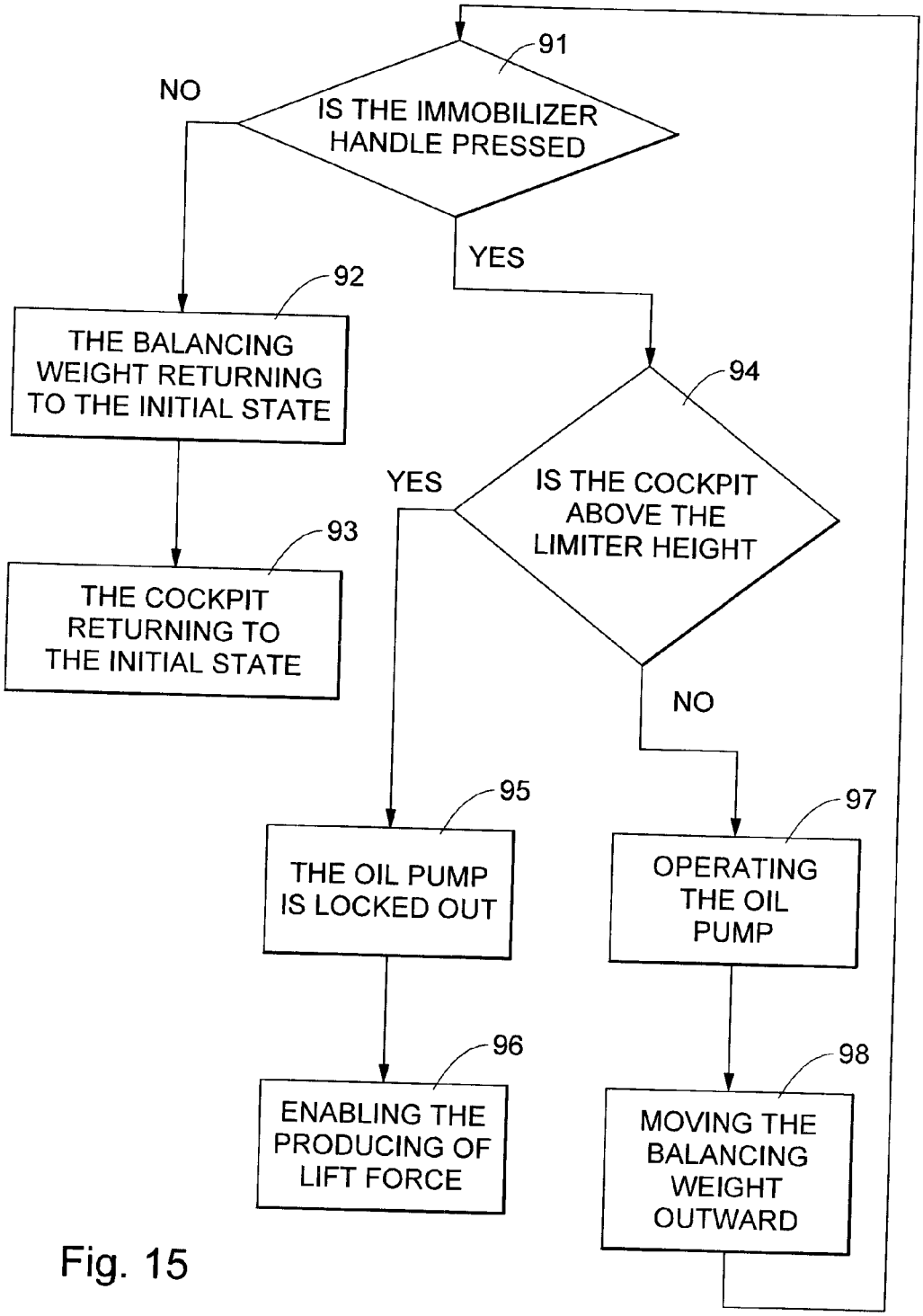
FIG. 15 is a flowchart of a method for operation of the hydraulic systems of the helicopter amusement apparatus, according to some embodiments of the invention.

FIG. 15 is a flowchart of a method for operation of the hydraulic systems 70 of the helicopter amusement apparatus 1, according to some embodiments of the invention.

The method includes the stages of checking if the immobilizer handle is pressed (stage 91), if not:

returning the balancing weight to the initial state (stage 92); and returning the cockpit to the initial state (stage 93), if so:

checking if the cockpit is above the limiter height (stage 94), if so:

disabling the oil pump (stage 95), and enabling the production of lift force (stage 96), if not:

operating the oil pump (stage 97), and moving the balancing weight outward (stage 98).

According to FIGS. 3-15 and their accompanying description, the method of activation of the helicopter amusement apparatus 1 can now be understood.

At the beginning of activation, a user, referred to as a pilot 2, takes a seat in pilot seat 31, and places his or her feet upon the pedals 33. The pilot 2 can be a child or an adult, however there may be an upper weight limit established for the pilot 2 (stage 61).

With one hand, for example the right hand as shown in the illustrations, the pilot 2 presses on the immobilizer handle 35 near the head of the steering stick 32, while using the other hand to perform pumping motions with the climbing handle 34, which activates the oil pump 73. In this state, hydraulic pressure is formed, and oil 72 flows to the rear side 77*r* of the balancing weight piston 77 (stage 62) causing it to push the balancing weight 80 until the cockpit 30 starts to ascend. The beginning of ascent depends upon the exact location of the balancing weight 80, which depends on the weight of the pilot 2 (stage 63).

Above a certain given height of the cockpit 30, the height limiter valve 78 is pressing, and hydraulic pressure cannot be increased any further (stage 64).

At this point, if the pilot 2 rotates the pedals 33 with his or her legs, the rotor 50 will also turn and generate lift force L.

If the rotation of the pedals 33 is sufficiently fast, the lift force L will cause the cockpit 30 to ascend higher (stage 65). The faster this rotation is, the higher the ascent will be.

Seeing as according to the present invention, the balancing weight 80 has been placed in a suitable position the lift force L necessary to start the ascent is small relative to the weight of the pilot 2, and can be achieved by means of a rather small force, such as two kilograms, for example, so as to be suitable for activation by a child without need for excessive force.

At this point, if the pilot 2 pushes and tilts the steering stick 32 forward, the rotor pole 40 and the rotor 50 will also tilt forward and provide a thrust force T to move the cockpit 30 forward, by tangential movement, creating rotational movement around the main pole 10 (stage 66).

At any time the pilot 2 chooses to relieve the pressure, or in other words the pressing, from the immobilizer handle 35, the hydraulic pressure will cease to act upon the balancing weight piston 77, and the pneumatic pressure from the accumulator 79 will return it along with the balancing weight 80 to the initial state (stage 67).

In order to prevent excessively fast fluctuations and to limit the extent of possible fluctuation from top to bottom of the main beam 20, the helicopter amusement apparatus 1 is equipped with a confinement device 27, which works with a similar principle to that of viscous friction, namely, the faster the fluctuation, the larger the resistance to the fluctuation.

While the invention has been described with respect to a limited number of embodiments, it will be appreciated that many variations, modifications and other applications of the invention may be made.

What is claimed is:

1. A helicopter amusement apparatus (1) for a pilot (2), the helicopter amusement apparatus (1) comprising:

(a) a main pole (10), wherein said main pole (10) is positioned vertically, wherein at least part of said main pole (10) has a horizontal rotational movement (24) capability;

(b) a main beam (20) mechanically connected to said main pole (10), wherein said main beam (20) has a limited vertical rotational movement (23) capability;

(c) a cockpit (30), wherein said cockpit (30) is mechanically connected to said main beam (20), and wherein said cockpit (30) is suspended below said main beam (20);

(d) a rotor (50) for producing lift and thrust forces, mechanically connected to said cockpit (30); and (e) a balancing weight (80) having limited linear movement (82) capability along said main beam (20), wherein rotation of said rotor (50) is by means of mechanical power produced by the legs (21) of said pilot (2) and transmitted to said rotor (50) by a mechanical transmission system (40), and wherein linear movement (82) of said balancing weight (80) is generated by a hydraulic system (70), wherein said hydraulic system (70) transmits power produced by a hand (2*h*) of said pilot (2);

(f) a main beam shaft (25) mechanically connected on said main beam (20) enabling said vertical rotational movement (23) of said main beam (20);

(g) a cockpit carrying beam (22) for carrying said cockpit (30) said cockpit carrying beam (22) is mechanically connected to said main beam (20) by an axis (15);

(h) a parallelogram beam (21) for keeping said cockpit carrying beam (22) vertical, said parallelogram beam (21) is mechanically connected to said cockpit carrying beam (22) by an axis (15); and (i) a main pole ring (12) mechanically connected to said main pole (10) said main pole ring (12) having shaft carriers (13) wherein said main beam shaft (25) is mounted on said shaft carriers (13), and wherein said parallelogram beam (21) is mechanically connected to said main pole ring (12) by an axis (15).

2. The helicopter amusement apparatus (1) of claim 1 wherein said balancing weight (80) has a balancing weight center of gravity (81), wherein said main beam shaft (25) has a main beam shaft section center (25*a*), and wherein when said main beam (20) is in a horizontal position, said main beam shaft section center (25*a*) being higher than said balancing weight center of gravity (81) by a balancing weight center of gravity height ($h_t$).

3. The helicopter amusement apparatus (1) of claim 2 wherein said balancing weight center of gravity height ($h_t$) is at least one centimeter.

4. The helicopter amusement apparatus (1) of claim 2 further comprising:

(j) a piston cylinder (77*b*) mechanically connected to said main beam (20)

(k) a balancing weight piston (77) having a front end (77*f*) a rear end (77*r*) located inside said piston cylinder (77*b*); and (l) a piston connecting rod (77*a*) mechanically connected to said balancing weight piston (77) and mechanically connected to said balancing weight (80).

5. The helicopter amusement apparatus (1) of claim 4 wherein said cockpit (30) includes:

(i) a cockpit floor (38);

(ii) a pilot seat (31) mechanically connected to said cockpit floor (38);

(iii) a steering stick (32) mechanically connected to said floor (38) by an axis (15) wherein said steering stick (32) has a rotational movement capability with relation to said floor (38);

(iv) a climbing handle (34) mechanically connected to said floor (38), wherein said climbing handle (34) has a rotational movement capability with relation to said floor (38);

(v) a pedal shaft (33*a*) mechanically connected to said floor (38) wherein said pedal shaft (33*a*) has a rotational movement capability with relation to said floor (38);

(vi) a pedal (33) mechanically connected to said pedal shaft (33*a*); and (vii) a immobilizer handle (35) mechanically connected to said steering stick (32) by an axis (15).

6. The helicopter amusement apparatus (1) of claim 5 wherein said helicopter amusement apparatus (1) further comprises:

(m) a pitch bars assembly (37) mechanically connected to and between said cockpit carrying beam (22) and said cockpit (30) in such a way that changing a steering stick angle (32*a*) of said steering stick (32) causes a change of a pitch angle (32*b*) of said cockpit (30).

7. The helicopter amusement apparatus (1) of claim 6 wherein said pitch bars assembly (37) includes:

(i) a first bar (37*a*) mechanically connected to and between said cockpit carrying beam (22) and said cockpit (30) having a rotational movement capability in relation to said cockpit carrying beam (22);

(ii) a second bar (37*b*) mechanically connected to said first bar (37*a*);

(iii) a third bar (37*c*) mechanically connected to said second bar (37*b*) having a rotational movement capability in relation to said second bar (37*b*); and (iv) a fourth bar (37*d*) mechanically connected to and between said third bar (37*c*) and said steering stick (32) having a rotational movement capability in relation to said third bar (37*c*) and said steering stick (32).

8. The helicopter amusement apparatus (1) of claim 5 wherein said cockpit (30) further includes:

a dynamo (36) mechanically connected to said cockpit floor in such a way that a rotating of said pedal (33) causes said dynamo (36) to generate and provide electrical power.

9. The helicopter amusement apparatus (1) of claim 5 wherein said mechanical transmission system (40) includes:

(i) a first cog wheel (43*a*) mechanically connected to said pedal shaft (33*a*);

(ii) a second cog wheel (43*b*);

(iii) a first chain (42*a*) wound on said first cog wheel (43*a*) and on said second cog wheel (43*b*);

(iv) a third cog wheel (43*c*) mechanically connected to said second cog wheel (43*b*);

(v) a fourth cog wheel (43*d*);

(vi) a second chain (42*b*) wound on said third cog wheel (43*c*) and on said fourth cog wheel (43*d*);

(vi) a gear box (44) mechanically connected to said cockpit (30) and to said fourth cog wheel (43*d*); and (viii) a rotor pole (41) mechanically connected to said gear box (44).

10. The helicopter amusement apparatus (1) of claim 9 wherein said rotor (50) is mechanically connected to said rotor pole (41) and wherein said rotor (50) includes:

(i) at least two rotor wings (51) wherein each one of said rotor wings (51) has a wing aerodynamic profile (52).

11. The helicopter amusement apparatus (1) of claim 5 wherein said hydraulic system (70) includes:

(i) an accumulator (79) pneumatically connected to said balancing piston cylinder (77*b*);

(ii) an oil tank (71) hydraulically connected to said balancing piston cylinder (77*b*); and (iii) an oil pump (73) hydraulically connected to and between said balancing piston cylinder (77*b*) and said oil tank (71) and mechanically connected to said climbing handle (34).

12. The helicopter amusement apparatus (1) of claim 11 wherein said hydraulic system (70) further includes:

(iv) an immobilizer (76) hydraulically connected to and between said oil pump (73) and said balancing piston cylinder (77*b*) and hydraulically connected to said oil tank (71) and mechanically connected to said immobilizer handle (35); and (v) a height limiter valve (78) hydraulically connected to and between said immobilizer (76) and balancing piston cylinder (77*b*).

* * * * *